US012296233B2

(12) United States Patent
Ende

(10) Patent No.: US 12,296,233 B2
(45) Date of Patent: May 13, 2025

(54) GOLF PUTTER HEAD

(71) Applicant: Mathias Am Ende, Temecula, CA (US)

(72) Inventor: Mathias Am Ende, Temecula, CA (US)

( * ) Notice: Subject to any disclaimer, the term of this patent is extended or adjusted under 35 U.S.C. 154(b) by 0 days.

(21) Appl. No.: 17/977,895

(22) Filed: Oct. 31, 2022

(65) Prior Publication Data

US 2024/0139587 A1 May 2, 2024

(51) Int. Cl.
*A63B 53/04* (2015.01)

(52) U.S. Cl.
CPC ..... *A63B 53/042* (2020.08); *A63B 53/0487* (2013.01)

(58) Field of Classification Search
CPC ... A63B 53/02; A63B 53/007; A63B 53/0487; A53B 53/02; A53B 53/04; A53B 53/007; A53B 53/0487
See application file for complete search history.

(56) References Cited

U.S. PATENT DOCUMENTS 1,895,417 A * 1/1933 Lard ..... A63B 53/02 473/310
1,906,239 A * 5/1933 Reach ..... A63B 60/00 473/310
3,640,534 A * 2/1972 Mills ..... A63B 53/0466 473/311
4,569,524 A * 2/1986 Quijano ..... A63B 53/0466 473/342
5,377,979 A * 1/1995 Long ..... A63B 53/007 273/DIG. 8
6,110,057 A * 8/2000 Mckinnon ..... A63B 53/007 473/331
10,279,229 B1 * 5/2019 Day ..... A63B 53/007
10,758,794 B1 * 9/2020 Day ..... A63B 53/007
2002/0016220 A1 * 2/2002 Franco ..... A63B 53/0487 473/340
2006/0009306 A1 * 1/2006 Bauer ..... A63B 53/04 473/324
2011/0281666 A1 * 11/2011 Hair ..... A63B 53/0487 473/340
2012/0252596 A1 * 10/2012 Cameron ..... A63B 60/00 473/316
2013/0095953 A1 * 4/2013 Hotaling ..... B23P 17/04 473/332
2014/0187344 A1 * 7/2014 Jones ..... A63B 53/0487 473/307

(Continued)

FOREIGN PATENT DOCUMENTS

CA 2212651 A * 2/1999 ..... A63B 53/0487
CA 2212651 A1 * 2/1999

(Continued)

*Primary Examiner* — Alvin A Hunter
(74) *Attorney, Agent, or Firm* — Lewis Anten, Esq.; LEWIS ANTEN, P.C.

(57) ABSTRACT

A golf putter head has a face for positioned for striking a golf ball, with a support base made of metal material and a hosel adapted for connection to a golf shaft and granite attached to the support base and at least a portion of the granite on the face of the golf putter head. Also, a golf putter head made of granite, with an opening in the top of the golf putter head for receiving a golf shaft and the opening is surrounded by a resilient material.

6 Claims, 9 Drawing Sheets

(56) References Cited

U.S. PATENT DOCUMENTS

2017/0319925 A1* 11/2017 Hotaling ..... A63B 60/54

FOREIGN PATENT DOCUMENTS

| | | | | | |
|---|---|---|---|---|---|
| DE | 202007015235 | U1 | * | 2/2008 | ..... A63B 53/04 |
| DE | 202007018513 | U1 | * | 11/2008 | ..... A63B 53/0487 |
| DE | 202012007179 | U1 | * | 10/2012 | ..... A63B 53/007 |
| DE | 202014105738 | U1 | * | 4/2016 | ..... A63B 53/0487 |
| KR | 200299197 | Y1 | * | 1/2003 | |
| KR | 200329907 | Y1 | * | 10/2003 | |
| KR | 20040100825 | A | * | 12/2004 | |
| KR | 101011109 | B1 | * | 1/2011 | |
| KR | 20140074563 | A | * | 6/2014 | |
| WO | WO-2005021104 | A2 | * | 3/2005 | ..... A63B 53/0487 |
| WO | WO-2015160557 | A1 | * | 10/2015 | ..... A63B 53/0487 |

* cited by examiner

FIG.3
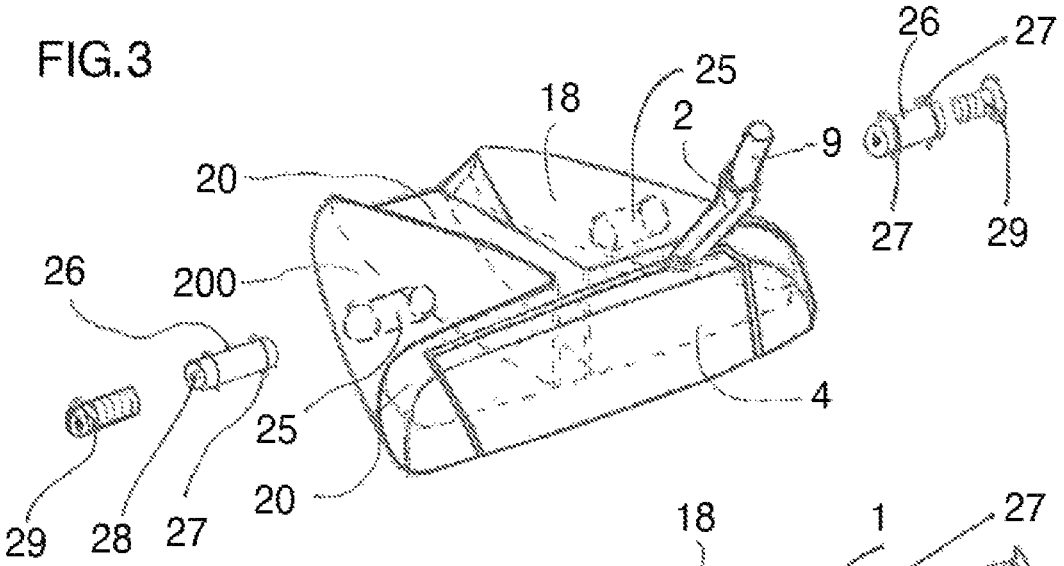
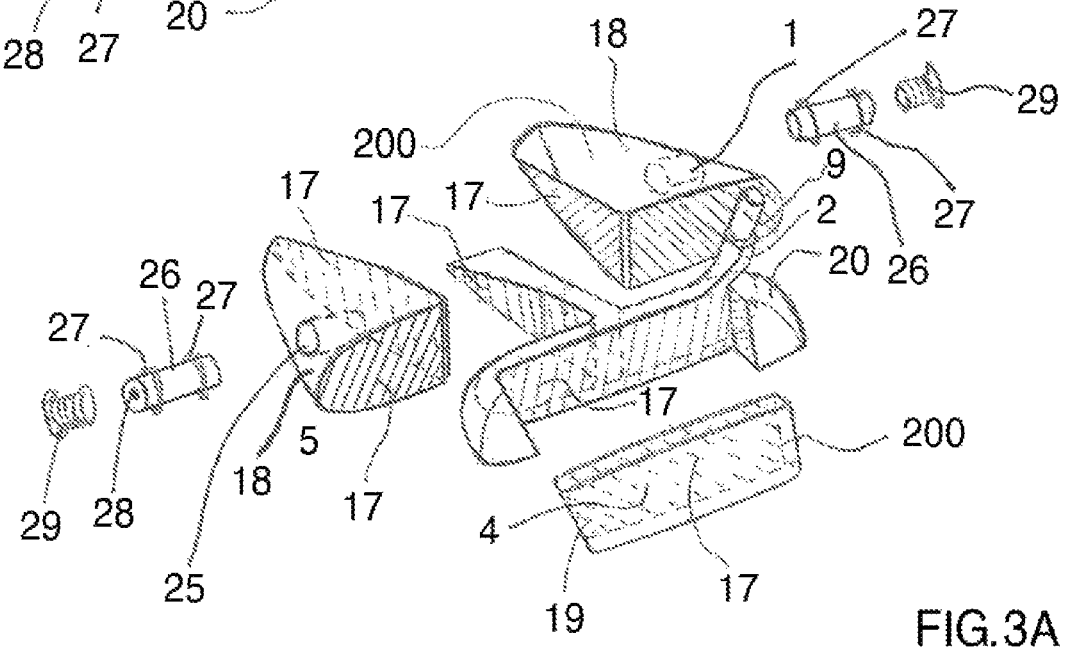
FIG.3A

FIG.4A
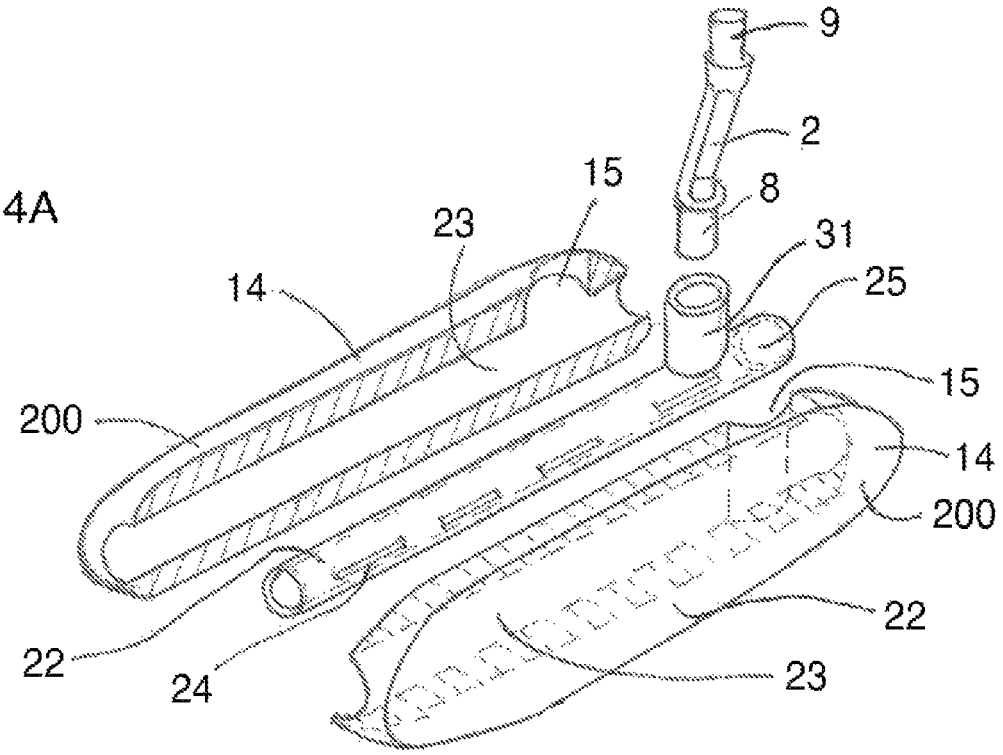
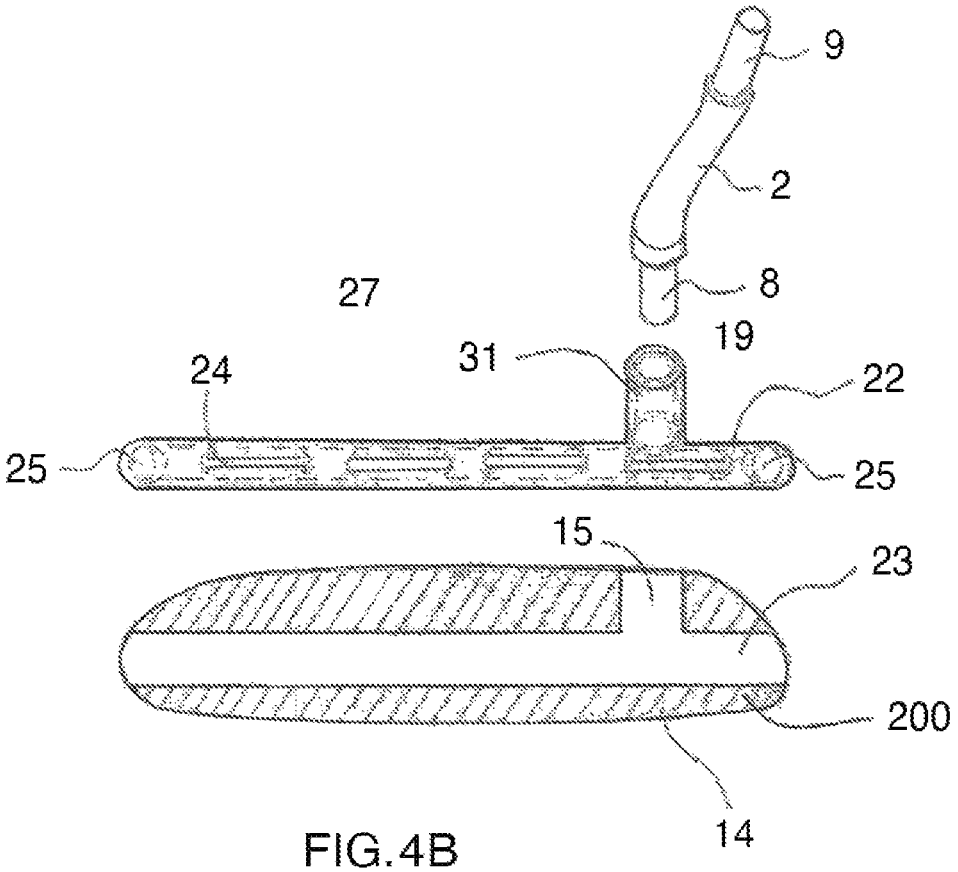
FIG.4B

GOLF PUTTER HEAD

BACKGROUND

The putter is a club that typically consists of a head that has a relatively flat front face and is connected to one end of a shaft that has a golf grip at the other end. A typical prior art putter is shown in FIGS. 1 and 1A. Golf putter heads come in different shapes, such as blade and mallet style. The different balance preferences from player to player are accomplished by the use of different hosels entering the putter head at the preferred angle The lie angle of a putter 100 is the angle in which the golf shaft 1 enters the putter head 5 relative to a level playing position of the putter 100. Some putters are manufactured in such way that the head 5 and the hosel 2 are one piece. Other putters have a hosel cavity 7 which is an opening or cavity in the club head that is slightly larger than the foot 8 of the hosel 2. This allows for great tunability, specific to the player. There are different hosel types such as straight neck, slanted or plumber's neck. The hosel usually has a round hosel tip 9 that is glued at one end onto the shaft tip 10 with golf epoxy, and the hosel foot 8 is glued into the hosel cavity 7 of the putter head 5. The golf epoxy softens between 600 and 700 degrees Fahrenheit so that applying heat with a heat gun permits disassembling the putter.

The hosel 2 is shaped in such way to position the club face 4 relative to the ground and target line to the player's preference. The lie angle of a common putter can vary, but is typically around 70 degrees with a loft angle on the putter face 19 in between 1 and 3 degrees. Golf putters are commonly balanced in three different ways: face balanced, toe balanced, and variable toe hangs. Face balanced means by balancing the shaft across your fingers with the golf shaft 1 in a horizontal position, the putter face 19 will automatically roll to a level position, parallel to the ground. In the toe balance, holding the putter shaft 1 in a horizontal position, the toe 3 of the club head 5 will automatically point down towards to the ground. The variable toe hang typically has the face of the putter being from 30-45° from the horizontal. The type of balance used by a golfer is based on the type of stroke used by the golfer. The correct putter set up, with its geometry and weighting is crucial to compliment the player's stroke and swing path.

There are numerous aspects in club design that influence the performance. A well "tuned" club has the right combination of lie angle, loft, head weight, balance, resonance, shaft flex and appearance to provide the right feel, sound and performance to the individual player. The result of a dynamic set up is maximum performance, which means fewer strokes in a golf game.

The putter design stimulates the golfer's confidence, which is a crucial element to provide improvement in the game of golf.

While each part of the club is designed for a specific purpose, particular material properties such as high tensile strength and hardness are utilized in parts of the club. Stainless steel or carbon fiber or similar unbreakable materials (hereinafter referred to as "metal"), for example allow for a sleek but strong design of the hosel which is the intermediate connection of the club head to the shaft and transfers all mechanical forces from the players hands into the face of the club head for impact into the golf ball.

There are two main directions of kinetic energy transmissions during the putting stroke, One is the force of the players stroke, transferred from the hands into the grip 6 to the shaft 1, through the hosel 2, into the club head 5, the club face 4 and finally into the golf ball.

The second chain of kinetic energy transmission travels the opposite way during impact, from the golf ball through the club face, head, hosel, shaft and grip into the player's hands, delivering the "feel". The sensation of feel during putting is described by the best players in the world. It is the dynamic feedback of all physical principals, occurring during a putt. The right feel is created by a combination of many different settings on the club, specific to the preference of the player.

There have been golf putter heads made entirely of stone, such as granite, marble or quartz. The term "stone" hereinafter refers to quartz, marble, granite and other similar materials. Such putter heads have an opening 7 drilled into the top surface of the putter head. The typical cylindrical surface area of bonding a shaft to a club head is approximately 1 square inch. The foot 8 of the hosel 2 is of such a size that it is either force fit into the opening or the foot is slightly smaller than the opening 7 and glue is used to attach the tip of the shaft to the stone putter head. Applying the shaft to the stone head in this fashion is not practical because the putter head will develop stress fractures around the area of the shaft entering the head, especially when the tip of the shaft is force fit into the opening 7.

Granite is a particularly desirable material for golf putter heads because of its unique properties. Granite is the oldest igneous rock in the world, believed to have been formed as long as 300 million years ago. It is the main component that makes up the earth's crust. The word granite comes from the Latin "granum", which means "a coarse grain". Granite has been used in construction since the ancient Egyptians.

Granite is one of the hardest substances in the world, second to diamonds. It is very tough and durable, weather resistant and accepts a brilliant polish. The exotic colors can vary from white, pink, gray or black, depending on the mineralogy. Granite contains between 20% and 60% quartz by volume and has a chemical composition of 70-77% silica, 11-13% alumina, 3-5% potassium oxide, 3-5% soda, 2-3% iron and 1% lime. Granite is rated 6 on the Mohs scale, has a density of ~165-172 pounds per cubic foot. The compression strength is above 200 MPa. The resonant frequency of granite is 6900 Hz. Granite's appearance, resonance, density, hardness, noncorrosive and acoustic properties make this a fine material to achieve better performance in putter design.

Quartz is a hard, crystalline mineral composed of silica. The atoms are linked in a continuous framework of silicon-oxygen tetrahedra, and has the chemical formula Si02.

SUMMARY OF THE INVENTION

A golf putter head has a support base made of metal material and a hosel receiver adapted for connection to the hosel of a golf shaft. Stone is attached to the top of the support base and the face of the golf putter head. The metal support base, with the attached hosel receiver prevents the forces from the hosel and shaft causing stress fractures in the stone putter head. Various forms of metal support bases are disclosed.

For golf putter heads made entirely of stone, where the foot of the hosel is attached to an opening in the top of the stone putter head, the foot of the hosel is surrounded by a sleeve of resilient material, such as rubber polycarbonate or teflon and other similar materials.

There are multiple designs of putter heads disclosed, having different putter heads, all are based on the same method of strategically distributing the impact forces of a golf ball into a large area of the material. This achieves a "suspended" or "float effect," resulting in a very smooth feel of the club as well as protecting the club head from damage.

In order to balance the stone putter heads, adjustable weights can be provided in the body of the putter heads.

Objects of the Present Invention

It is an object of the present invention to provide a putter head that has a better feel when putting;

It is another object of the present invention to provide a putter head that has an aesthetic design;

It is another object of the present invention to provide an assembly that will not be damaged;

It is another object of the present inventions that has a pleasing tone when contacting the golf ball;

It is yet another object of the present invention to provide a way to balance the putter head.

These and other objects of the present invention will be apparent from the description of the invention in the specification and accompanying drawings.

BRIEF DESCRIPTION OF THE DRAWINGS

FIG. 3 is a top perspective view of a first alternate embodiment of the present invention.

FIG. 3A is an exploded view of the putter head of FIG. 3.

FIG. 4A is a top perspective exploded view with the weights of the putter head of FIG. 4.

FIG. 4B is a side sectional view of the putter head of FIG. 4.

DETAILED DESCRIPTION OF THE DRAWINGS

Figures 1, 1A:
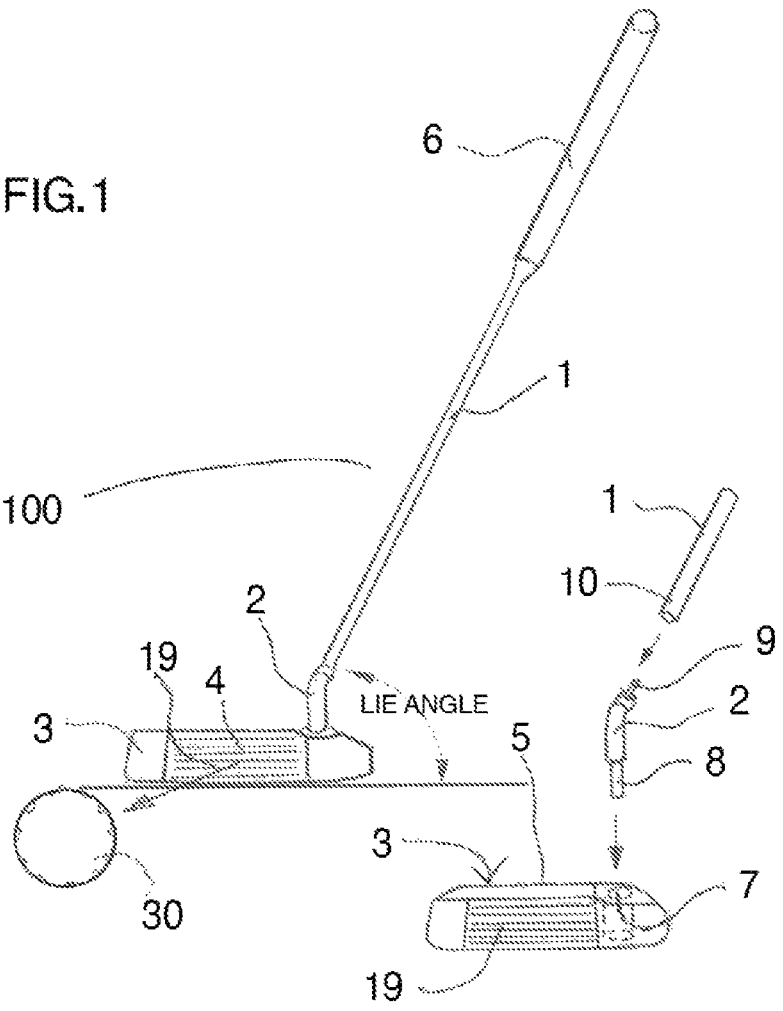
FIG. 1A (PRIOR ART)
FIG. 1 is a perspective view of a prior art putter.
FIG. 1A is an exploded view of the prior art putter of FIG. 1.

FIGS. 1 and 1A show the typical prior art putters as described above.

Figure 2:
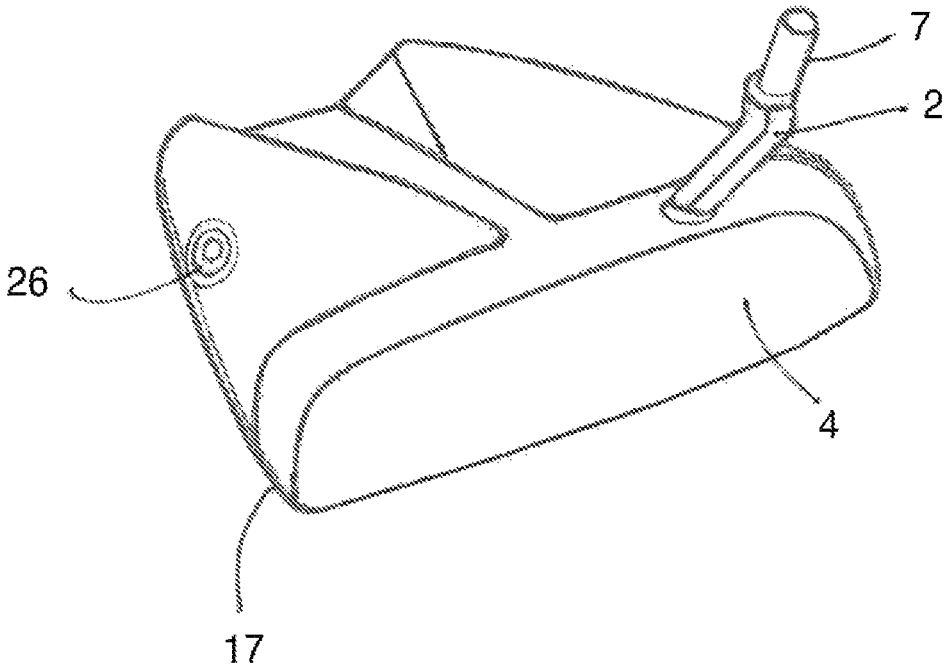
FIG. 2 is a top perspective view of the putter head of the first embodiment of the present invention.
Figure 2A:
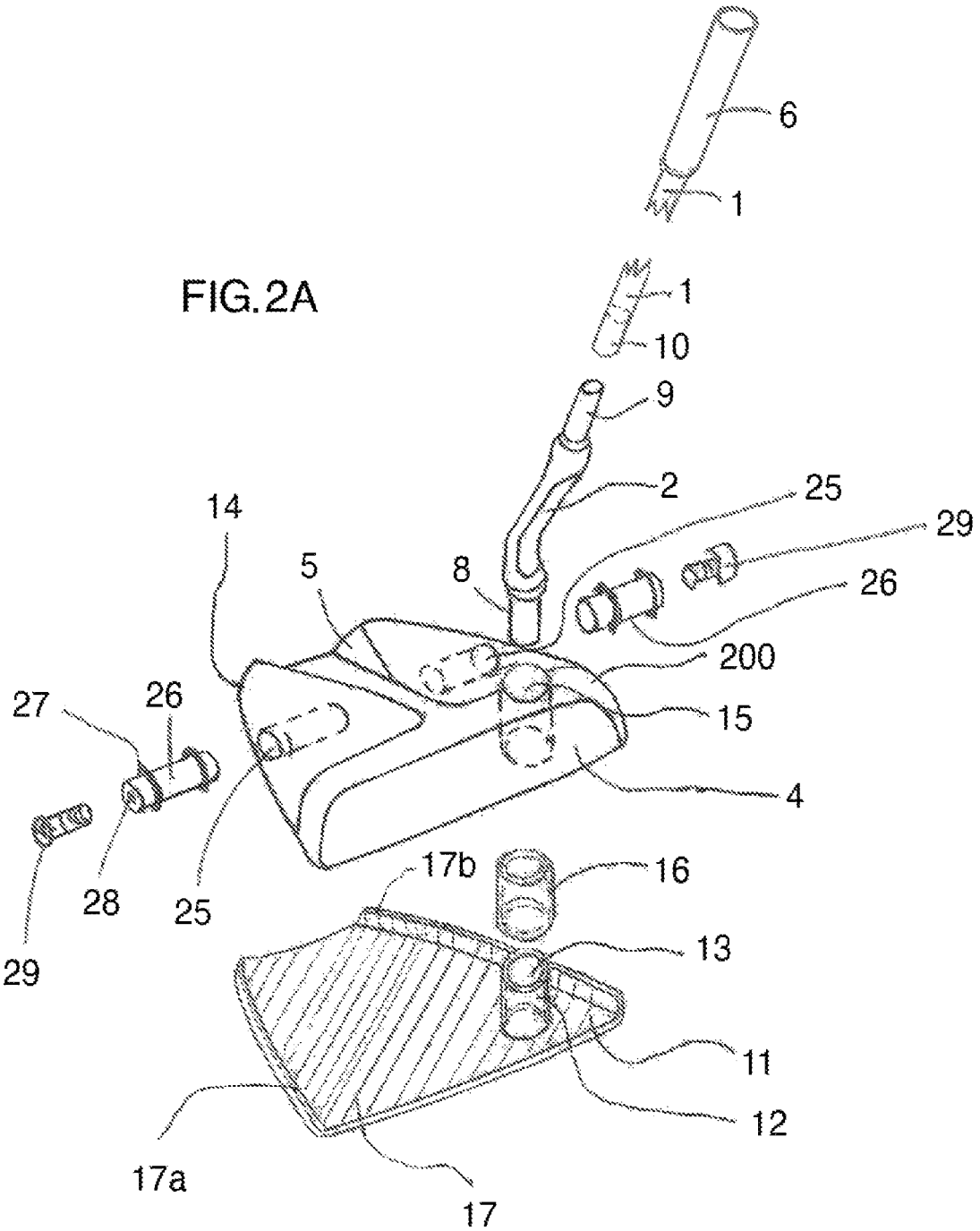
FIG. 2A is an exploded perspective view of the putter of FIG. 2.

Referring to FIGS. 2 and 2A the first embodiment of the present invention is shown. A mallet style putter head 14 made of stone is bonded to a metal support tray 17. The side walls 17*a* and 17*b* are used to fixate the head to the tray and to protect the stone head 14 from stress fractures. The height of the side walls in the preferred embodiment are from ⅛ inches to half the height of the head 14. It is also possible that there is an end wall opposite the putter face. The support tray 17 is a high tensile strength material, such as stainless steel, carbon steel or carbon fiber/Kevlar reinforced polyacrylonitrile (such materials are hereinafter referred to as "metal"). The support tray 17 is generally thin, flat and rectangular with upstanding side walls 17*a* and 17*b*. An upright hollow cylindrical hosel receiver 12 extends from the front top surface of the support tray 17 with an opening 13 on the top with dimensions slightly larger than the foot 8 of the hosel 2 attached to the shaft 9. The hosel receiver 12 is structurally part of the tray 17. The hosel receiver 12 and hosel foot 8 can be any shape, but are typically round. A hollow cylindrical sleeve member of a resilient material such as rubber surrounds the hosel receiver 12. The foot of the hosel fits within the opening 13 of the hosel receiver 12. The cylindrical hollow sleeve 16 of the hosel foot 8 is glued or otherwise surrounding the hosel receiver 12 with epoxy or other suitable adhesive. The stone putter head 14 is bonded to the top of the support tray 17, with a suitable adhesive.

Referring to FIGS. 3 and 3A an alternative embodiment of the present invention is shown. A mallet putter style head 14 has a metal support body 20 in the general form of a "T" having a front portion 17*a* and side portions 17*b* and 17*c*. A flat stone member is applied to the front portion 17*a* of the support body 20 to form the putter face 19 and stone members 17*d* and 17*e* are attached to the sides 17*b* and 17*c* of the support body 20. The support body 20 has an upstanding hollow hosel receiving member 9 for receiving the foot 8 of the hosel 2. The hosel 2 is glued with traditional golf epoxy to the hosel receiving member. Two weights 26 are provided. The weights 26 in this case are of cylindrical shape, each have at least one circular groove on either end, with a rubber O ring 27 installed, increasing the diameter of the head weight 26 slightly, to accommodate a tight fit in to the weight ports 25. A threaded hole 28 on either end of the weights 26 allows for installation and removal with a threaded tool. A cap screw 29 fits in to the threaded ends of the weight ports 25 to hold the weights 26 in place.

Referring to FIGS. 4A, 4B, and 4C a third alternative embodiment of present invention is shown.

Figure 4:
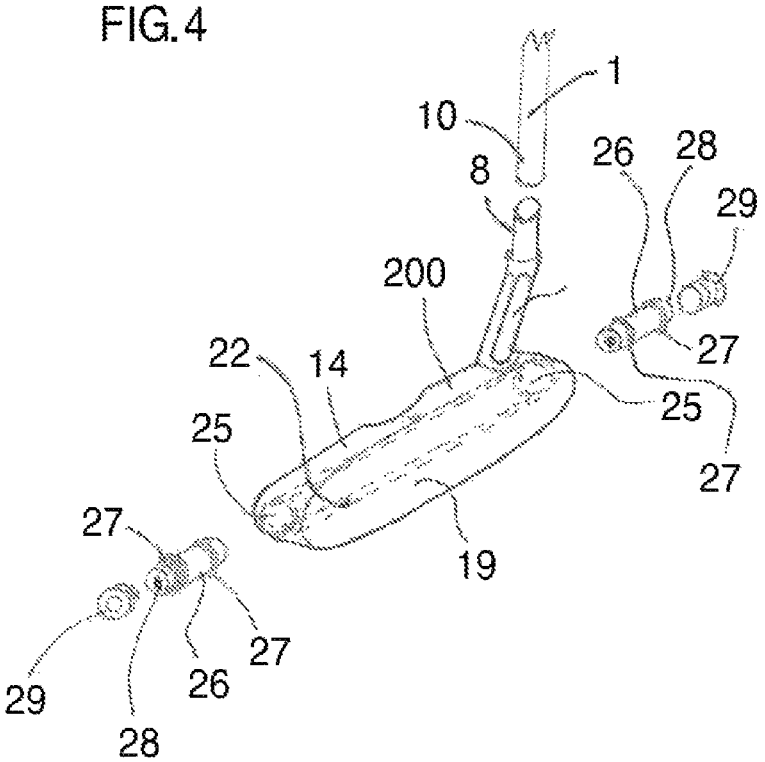
FIG. 4 is a top perspective view of a second embodiment of the present invention

FIG. 4 shows a blade style putter. The metal support member 22 is in the shape of a tubular barrel. The barrel support member 22 has openings parallel to the face on either or both ends for receiving weights 26 to balance distribution of the weight of the putter head.

The metal support member has an attached upstanding hosel receiving member 12 for receiving the foot of a hosel. A pair of stone members having an internal tubular depression corresponding to the tubular member are attached to the support member by a suitable adhesive, surrounding the support member with a flat portion 19 forming the putter face. The weights can also have external threads and the openings on the ends of the support member can have corresponding internal threads.

Figure 5:
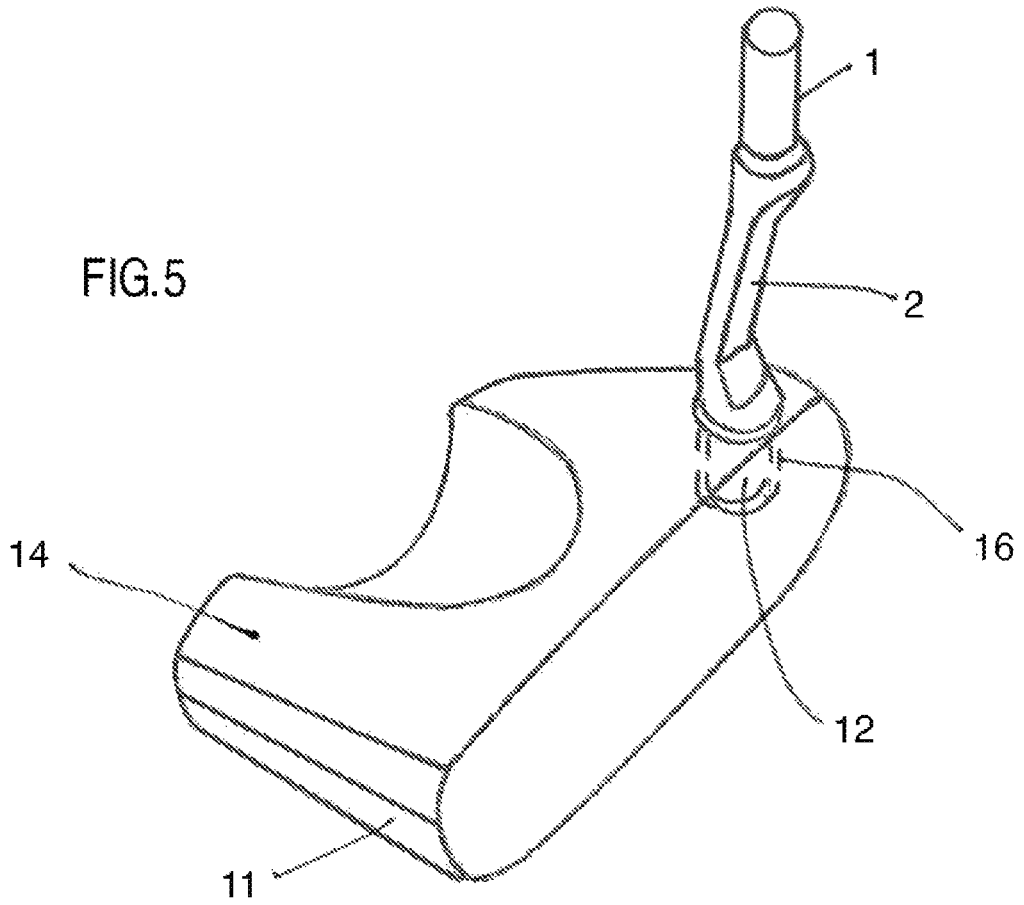
FIG. 5 is a top perspective view of the third embodiment of the present invention.
Figure 5A:
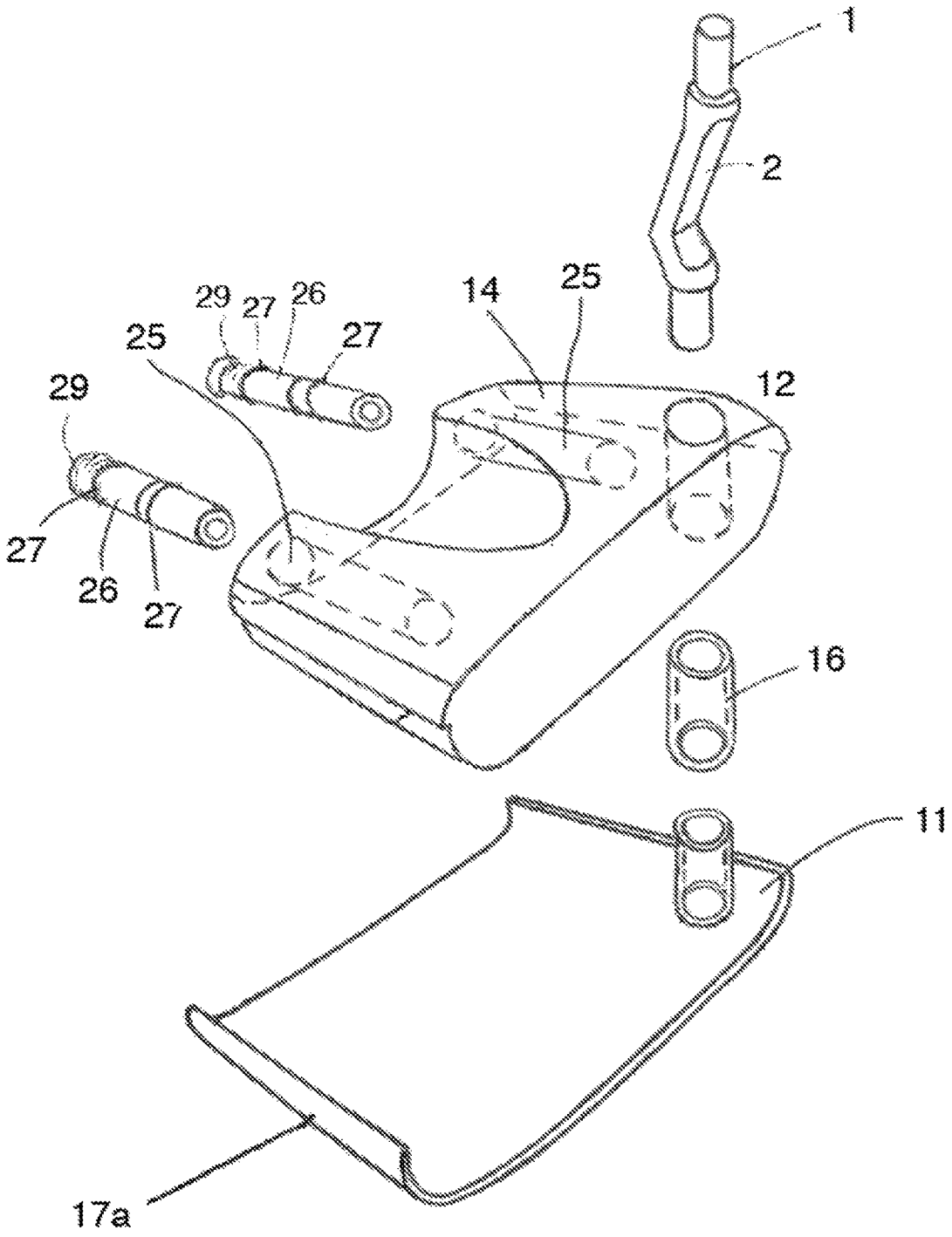
FIG. 5A is a perspective exploded view of the putter head of FIG. 5.

FIGS. 5 and 5A shows a mallet style putter head 14, bonded to a tray metal support tray 11 with 2 openings orthogonal to the face for receiving weights 26 inside the weight openings 25. The weights 26 provide a great spectrum of club balance choices. The weights 26 in this case are of cylindrical shape, each having at least one circular groove on either end, with a rubber o ring 27 installed, increasing the diameter of the head weight 26 slightly, to accommodate a tight fit in to the weight ports 25. A threaded hole 28 on either end of the weights 26 allows for installation/uninstallation with a threaded tool. A cap screw 29 fits in to the threaded ends of the weight ports 25 to hold the weights 26 in place.

Figure 6:
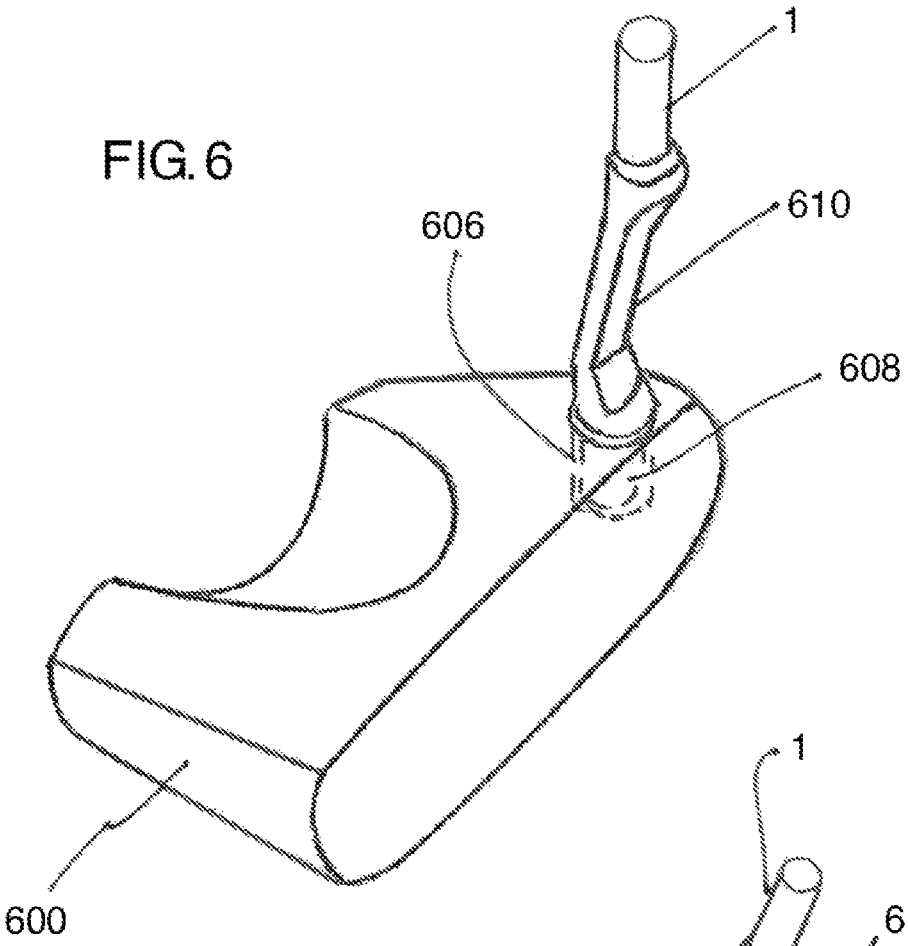
FIG. 6 is a top perspective view of a putter head made entirely of stone.
Figure 6A:
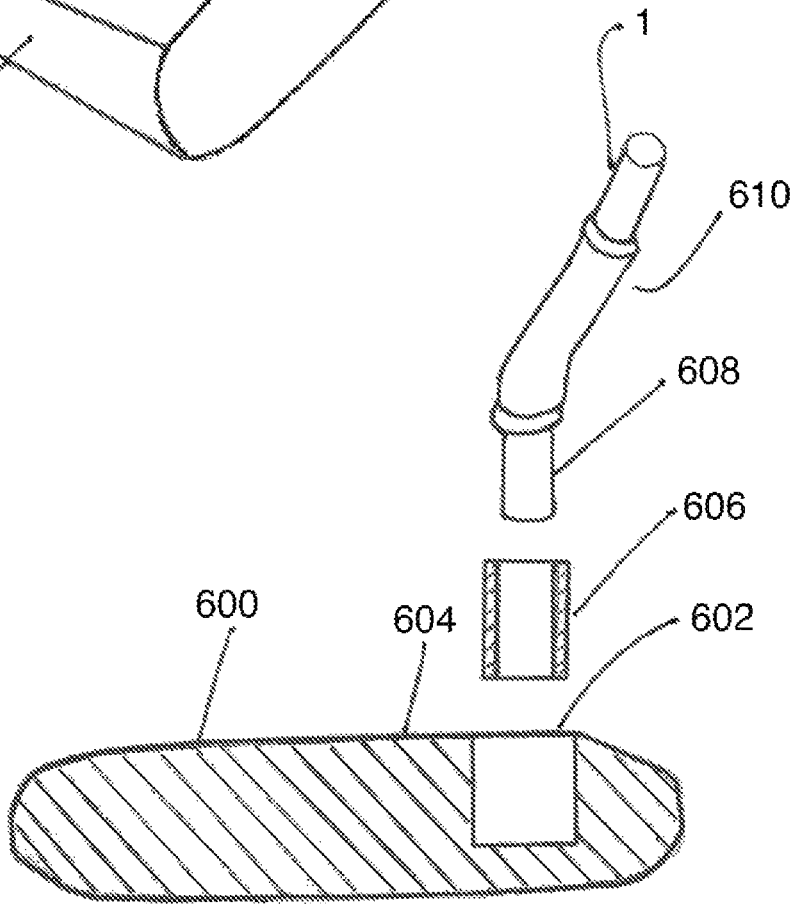
FIG. 6A is an exploded side sectional view of the putter head of FIG. 6.

Referring to FIGS. 6 and 6A a putter head is shown in which there is no metal supporting base, the putter head 600 made entirely of stone. The putter head can be of any shape. The putter head 600 has a circular opening 602 in its top surface 604. In the preferred embodiment, the opening 602 does not extend all the way through the putter head 600. A hollow cylindrical sleeve 606 made from a resilient material described above, surrounds the foot 608 of the hosel 610 within the circular opening 602. The hollow cylindrical sleeve 606 is fixed in place to the internal wall of the opening 602 and the foot 608 by epoxy or other adhesive material. The hollow cylindrical sleeve 606 made from resilient material prevents stress from the hosel 610 and shaft 1 from being transferred to the stone putter head 600, thereby avoiding stress fractures in the stone head 600.

The description of the disclosure is provided to enable any person skilled in the art to make or use the disclosure. Various modifications to the disclosure will be readily apparent to those skilled in the art, and the generic principles defined herein may be applied to other variations without departing from the spirit or scope of the disclosure. Thus, the disclosure is not intended to be limited to the examples and designs described herein but is to be accorded the widest scope consistent with the principles and novel features disclosed herein. The following goes at the end of the current detailed description of the invention Although several embodiments have been described in detail for purposes of illustration, various modifications may be made without departing from the scope and spirit of the present disclosure. Accordingly, the disclosure is not to be limited by the examples presented herein, but is envisioned as encompassing the scope described in the appended claims and the full range of equivalents of the appended claims.

The invention claimed is:

1. A golf putter head having a face positioned for striking a golf ball, said head comprising a support base made of metal material having an upper surface, said support base having a hosel receiver member, and stone attached to said support base with at least a portion of said stone on the face of said golf putter head in which said stone encloses substantially all of said support base.

2. A golf putter head having a face positioned for striking a golf ball, said head comprising a support base made of metal material, having an upper surface, said support base having a hosel receiver member, and stone attached to said support base with at least a portion of said stone on the face of said golf putter head in which said stone includes at least one opening orthogonal to the face.

3. The golf putter head of claim 2 in which an adjustable metal member is movably fixed in said opening.

4. The golf putter head of claim 3 in which the orthogonal opening has an internal screw thread.

5. The Golf putter head of claim 4 in which the adjustable metal member has an external thread corresponding to said internal thread of said orthogonal opening.

6. The golf putter head of claim 2 in which there are at least two openings orthogonal to the face.

* * * * *